United States Patent [19]

Abe et al.

[11] Patent Number: 4,975,215

[45] Date of Patent: Dec. 4, 1990

[54] PROCESS FOR IMPROVING THE COEFFICIENT OF TRACTION AND TRACTION DRIVE FLUID COMPOSITION

[75] Inventors: Kazuaki Abe; Toshiyuki Tsubouchi, both of Sodegaura; Hitoshi Hata, Ichihara, all of Japan

[73] Assignee: Idemitsu Kosan Co., Ltd., Tokyo, Japan

[21] Appl. No.: 234,013

[22] Filed: Aug. 18, 1988

[30] Foreign Application Priority Data

| | | | |
|---|---|---|---|
| Sep. 4, 1987 | [JP] | Japan | 62-220251 |
| Sep. 19, 1987 | [JP] | Japan | 62-235693 |
| Oct. 12, 1987 | [JP] | Japan | 62-254650 |
| Dec. 19, 1987 | [JP] | Japan | 62-322479 |
| Mar. 31, 1988 | [JP] | Japan | 63-75835 |

[51] Int. Cl.[5] ..... C09K 5/00

[52] U.S. Cl. ..... 252/73; 252/71

[58] Field of Search ..... 252/71, 73

[56] References Cited

U.S. PATENT DOCUMENTS

| | | | |
|---|---|---|---|
| 3,359,797 | 7/1971 | Duling et al. | 252/73 |
| 3,595,796 | 7/1971 | Duling et al. | 252/73 |
| 3,597,358 | 8/1971 | Duling et al. | 252/73 |
| 3,598,740 | 8/1971 | Duoling et al. | 252/73 |
| 3,843,537 | 10/1974 | Duling et al. | 252/73 |
| 4,043,927 | 8/1977 | Duling et al. | 252/52 R |

FOREIGN PATENT DOCUMENTS

| | | |
|---|---|---|
| 208541 | 1/1987 | European Pat. Off. . |
| 230920 | 1/1987 | European Pat. Off. . |
| 224259 | 6/1987 | European Pat. Off. . |
| 207776 | 7/1987 | European Pat. Off. . |
| 230930 | 1/1989 | European Pat. Off. . |
| 1806401 | 6/1969 | Fed. Rep. of Germany . |

*Primary Examiner*—Paul Lieberman
*Assistant Examiner*—John F. McNally
*Attorney, Agent, or Firm*—Frishauf, Holtz, Goodman & Woodward, P.C.

[57] ABSTRACT

A process for improving the coefficient of traction between at least two relatively rotatable elements in a torque transmitting relationship, and traction drive fluid composition. This composition contains the hydrogenated product of a dimer, a trimer or a polymer having a degree of polymerization of more than 3 of a cyclic monoterpenoid monomer, and exhibits excellent traction performance over a wide temperature range from low temperature to high temperature.

23 Claims, 7 Drawing Sheets

PROCESS FOR IMPROVING THE COEFFICIENT OF TRACTION AND TRACTION DRIVE FLUID COMPOSITION

BACKGROUND OF THE INVENTION

The present invention relates to a process for improving the coefficient of traction and a traction drive fluid composition for use therein More particularly, it is concerned with a process for improving the coefficient of traction between at least two relatively rotatable elements in a torque transmitting relationship and a traction drive fluid composition for use therein A traction drive fluid is a fluid to be used in traction drives (friction driving equipment utilizing rolling contact), such as continuously variable transmissions for cars or industrial machines and hydraulic machines. In general, such traction drive fluids are required to have a high traction coefficient, high stability against heat and oxidation and furthermore to be inexpensive.

In recent years, investigations have been made to reduce the size and weight of the traction drive unit, particularly for use in cars. With this miniaturization and reduction in weight of the traction drive unit, the traction drive fluid to be used in such traction drive units is now required to have such high performance that it be used under severe conditions, particularly to have a high traction coefficient, a suitable viscosity, and high stability against heat and oxidation in a stabilized manner over a wide temperature range of from low temperature to high temperature (specifically from about −30° C. to 140° C).

Various traction drive fluids have been proposed as described in, for example, Japanese Patent Publication Nos. 338/1971, 339/1971, 35763/1972, 42067/1973, 42068/1973, 36105/1978, 42956/1987, 15918/1986, 44918/1986, 27838/1983, and 44391/1985. These traction drive fluids, however, fail to satisfy the requirements as described above. For example, compounds having a high traction coefficient at high temperatures produce a large agitation loss because of high viscosity thereof and, therefore, have disadvantages in that the transmission efficiency is low and start-up property at low temperatures is poor. On the other hand, compounds which are of low viscosity and are excellent in transmission efficiency have a low traction coefficient at high temperatures, and as the temperature rises, their viscosities drop excessively, causing troubles in lubricity of the traction transmission unit.

SUMMARY OF THE INVENTION

An object of the present invention is to provide a process for improving the coefficient of traction between at least two relatively rotatable elements in a torque transmitting relationship.

Another object of the present invention is to provide a traction drive fluid composition exhibiting excellent performance over a wide temperature range from low temperature to high temperature.

Another object of the present invention is to provide a traction drive fluid composition having a high traction coefficient and a low viscosity.

Still another object of the present invention is to decrease the size and weight of a traction drive unit, to lengthen its service life, and to increase its power.

The present invention relates to a process for improving the coefficient of traction between at least two relatively rotatable elements in a torque transmitting relationship which comprises introducing between the tractive surface of said elements a traction drive fluid comprising as the active component at least one hydrogenated cyclic monoterpenoid polymer having a degree of polymerization of two or more.

The present invention also relates to a traction drive fluid composition for use therein which comprises the polymer as the active component.

In the specification, hydrogenated cyclic monoterpenoid polymer having a degree of polymerization of two or more means the hydrogenated product of a dimer of cyclic monoterpenoid, the hydrogenated product of a trimer of cyclic monoterpenoid, the hydrogenated product of polymers having a polymerization degree of at least four of cyclic monoterpenoid or a mixture thereof.

DESCRIPTION OF PREFERRED EMBODIMENTS

Figure 1:
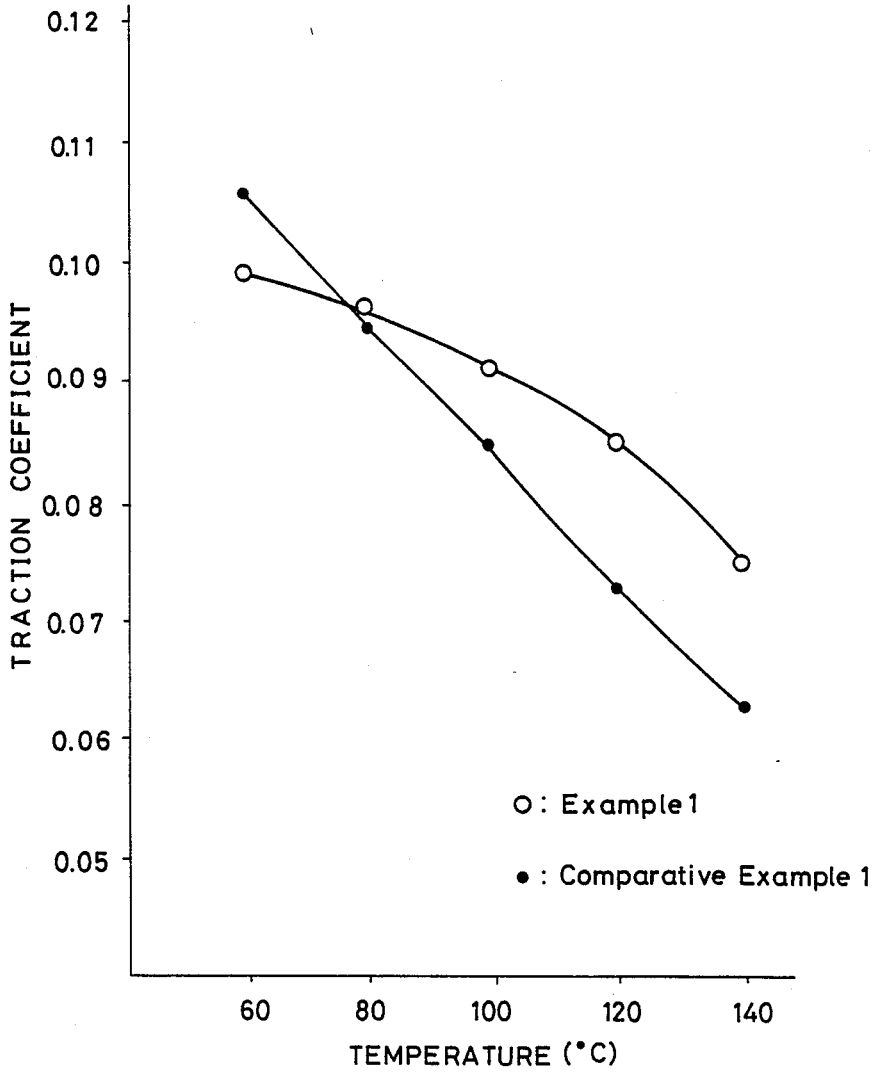
FIGS. 1 to 7 are graphs showing a traction coefficient vs. temperature relation of the traction drive fluids obtained in Examples and Comparative Examples.

Preferred examples of cyclic monoterpenoids to be used in the present invention are menthadienes, pinenes, bicyclo (2.2.1) heptanes and mixtures thereof.

Menthadienes are compounds having a basic skeleton that a cyclohexane ring is substituted by a methyl group and an isopropyl group at 1,2, 1,3 or 1,4-positions, and contains two carbon-carbon double bonds therein. Representative examples are d-, 1- and dl-isomers of limonene, isolimonene, α-, β-, and γ-terpinene, α-, and β-phellandonene, terpinolene sylvestrene, and the like. In addition, compounds resulting from substitution of the above compounds with an alkyl group, a hydroxyl group and the like can be used. Of these, unsubstituted menthadienes are preferred. These menthadienes can be used alone or as mixtures comprising two or more thereof Pinenes include α-pinene (d-, 1- and dl-isomers), β-pinene (d- and 1-isomers), δ-pinene (d- and 1-isomers), orthodene and the like. In addition, compounds resulting from substitution of the above compounds with an alkyl group, a hydroxyl group and the like can be used. Of these, unsubstituted pinenes are preferred. These pinenes can be used alone or as mixtures comprising two or more thereof.

Bicyclo (2.2.1) heptanes include camphene (d- 1 and dl-isomers), bornylene (d- and 1-isomers) α-fenchene (d-, 1-and dl-isomers), β-fenchene (d- and dl-isomers), γ-fenchene, δ-fenchene, ε-fenchene, ζ-fenchene, borneol (d, 1- and dl-isomers), π-borneol (d- and 1-isomers), ω-borneol, isoborneol (d-, 1- and dl-isomers), camphene hydrate, α-fenchyl alcohol (d-, 1- and dl-isomers) β-fenchyl alcohol (d-, 1- and dl-isomers), α-isofenchyl alcohol (d, 1- and dl-isomers), β-isofenchyl alcohol (d-, 1- and dl-isomers), and the like. In addition, compounds resulting from substitution of the above compounds with an alkyl group, a hydroxyl group and the like can be used. These bicyclo (2.2.1) heptanes can be used alone or as mixtures comprising two or more thereof.

The dimer of cyclic monoterpenoid as used herein means any one or both of the dimer of the same cyclic monoterpenoid and the codimer of different cyclic monoterpenoids. Similarly, the trimer or polymer of cyclic monoterpenoid as used herein means any one or both of the trimer or polymer of the same cyclic monoterpenoid and the cotrimer or copolymer of different cyclic monoterpenoids The above dimerization, or trimerization or polymerization of cyclic monoterpenoids is usually carried out in the presence of a catalyst, if necessary, in a solvent and in the presence of a reaction controlling agent. Various catalysts can be used in the polymerization (including dimerization, trimerization and so on) of cyclic monoterpenoids. In general, an acid catalyst is used. More specifically, clays such as activated clay, acidic clay and the like, mineral acids such as sulfuric acid, hydrochloric acid, hydrofluoric acid and the like, organic acids such as p-toluenesulfonic acid, triflic acid, and the like. Lewis acids such as aluminum chloride, ferric chloride, stannic chloride, boron trifluoride, boron tribromide, aluminum bromide, gallium chloride, gallium bromide and the like, solid acids such as zeolite, silica, alumina, silica-alumina, a cationic ion exchange resin, heteropolyacid and the like, and so on can be used. In practice, a suitable catalyst is appropriately chosen taking into consideration various factors such as ease of handling, cost and so on. The amount of the catalyst used is not critical and can vary over a wide range. Usually the catalyst is used in an amount of 0.1 to 100% by weight based on the weight of the cyclic monoterpenoids, with the range of 1 to 20% by weight being preferred.

The polymerization of cyclic monoterpenoids does not always need a solvent. However, use of the solvent is preferred from viewpoints of ease of handling of the cyclic monoterpenoids or the catalyst during the reaction, and controlling of the reaction As the solvent, saturated hydrocarbons such as n-pentane, n-hexane, heptane, octane, nonane, decane, cyclopentane, cyclohexane, methylcyclohexane, decalin and the like can be used. In addition, when the catalyst is a catalyst of low activity, such as clays and the like, aromatic hydrocarbons such as benzene, toluene, xylene and the like, and tetralin and so on can be used.

The reaction controlling agent is used, if necessary, in order to favor the reaction of the cyclic monoterpenoids, particularly to increase the selectivity of the dimerization reaction. As the reaction controlling agent, carboxylic acids such as acetic acid, acid anhydrides such as acetic anhydride and phthalic anhydride, cyclic esters such as γ-butyrolactone and valerolactone, glycols such as ethylene glycol, mononitro compounds such as nitromethane and nitrobenzene, esters such as ethyl acetate, ketones such as mesityl oxide, aldehydes such as formalin and acetoaldehyde, cellosolve, polyalkylene glycol alkyl ethers such as diethylene glycol monoethyl ether, and the like can be used. Although the amount of the reaction controlling agent used is not critical, it is usually used in an amount of 0.1 to 20% by weight.

The temperature at which the cyclic monoterpenoids are polymerized in the presence of the catalyst is determined appropriately within the range of −30° C. to 180° C. depending on the type of the catalyst, the type of an additive and so on. For example, when clays or zeolites are used as the catalyst, the polymerization is carried out at a temperature of from room temperature to 180° C., preferably more than 60° C. In the case of other catalysts, the polymerization is carried out at a temperature of from −30° C. to 100° C., preferably 0 to 60° C.

When the cyclic monoterpenoid as starting material is an alcohol, a dehydration polymerization reaction proceeds.

The dimer, or trimer or polymer (including copolymer) of cyclic monoterpenoids thus obtained is then hydrogenated to obtain the desired hydrogenated product Hydrogenation may be applied to the whole polymer, or part of the polymer may be hydrogenated after fractionation or fractional distillation.

The above hydrogenation is usually carried out in the presence of a catalyst as in the above polymerization As the catalyst, so-called hydrogenation catalysts containing at least one of metals such as nickel, ruthenium, palladium, platinum, rhodium, iridium, copper, chromium, molybdenum, cobalt and tungsten can be used The amount of the catalyst used is 0.1 to 100% by weight, preferably 1 to 10% by weight based on the weight of the above polymer having a degree of polymerization of two or more.

In the hydrogenation, as in the above polymerization, a solvent can be used although it proceeds in the absence of a solvent. As the solvent, liquid saturated hydrocarbons such as n-pentane, n-hexane, heptane, octane, nonane, decane, dodecane, cyclopentane, cyclohexane, methylcyclohexane and the like can be used. In addition, liquid compounds such as aromatics, olefins, alcohols, ketones, and ethers can be used. Particularly suitable are saturated hydrocarbons.

In the hydrogenation reaction, the temperature is usually from room temperature to 300° C. and preferably 40 to 200° C., and the pressure is from atmospheric pressure to 200 kg/cm$^2$G and preferably from atmospheric pressure to 100 kg/cm$^2$G. The present hydrogenation can be carried out by the same operation as in the usual hydrogenation.

The hydrogenated product of the cyclic monoterpenoid polyer (dimer, trimer, tetramer or more) thus obtained can be used as traction drive fluids, if necessary, in admixture with other traction drive fluids although it can be used alone. The viscosity of the hydrogenated product varies with the degree of polymerization of the hydrogenated product. The hydrogenated product of a polymer having a low degree of polymerization, such as a dimer, can be effectively used alone. In the case of the hydrogenated product of a polymer having a high degree of polymerization, of 3 or more such as a trimer or tetramer, however, it is preferred that the hydrogenated product be blended with other traction drive fluids to increase the traction coefficient because it has a high viscosity. In this case, the amount of the hydrogenated product of the polymer blended is not critical and can be determined appropriately depending on the type of the hydrogenated product, the type of other traction drive fluid and so on. For example, in the case of the hydrogenated product of a dimer, the amount of the hydrogenated product used is at least 5% by weight preferably at least 30% by weight based on the total weight of the traction drive fluid. In the case of the hydrogenated product of a trimer or higher polymer, the amount of the hydrogenated product is 0.1 to 90% by weight, preferably 2 to 60% by weight based on the total weight of the traction drive fluid. In addition, a composition consisting of a major amount of the hydrogenated product of a dimer and a minor amount of the hydrogenated product of a trimer or higher polymer can be used.

The degree of polymerization of the hydrogenated polymer is not critical as long as it is at least 2. Usually, any one of those having a degree of polymerization of 2 to 10 (e.g., a dimer, a trimer, etc.) or mixtures thereof are used. The degree of polymerization can be easily controlled by suitably choosing polymerization conditions as described above.

As the other traction drive fluid to be used in admixture with the hydrogenated product of cyclic monoterpenoid polymer, as well as those conventionally used as traction drive fluids, various compounds such as oils which are unsuitable for use as traction drive fluids by themselves because of low traction performance thereof can be used. Examples are mineral oils such as paraffin-base mineral oil, naphtene-base mineral oil and intermediate mineral oil, and a wide variety of liquid materials such as alkylbenzene, polybutene, poly ($\alpha$-olefin), synthetic naphthenes, esters and ethers. Of these, alkylbenzene, polybutene and synthetic naphthene are preferred. Synthetic naphthene includes alkane derivatives having 2 or more cyclohexane rings, alkane derivatives having at least one cyclohexane ring and at least one decalin ring, alkane derivatives having at least two decalin rings and compounds having the structure that at lease two cyclohexane rings or decalin rings are directly bonded. Specific examples of such synthetic naphthenes are 1-cyclohexyl-1-decalylethane,
1,3-dicyclohexyl-3-methylbutan,, 2,4-dicyclohexylpentane
1,2-bis(methylcyclohexyl)-2-methylpropane,
1,1-bis(methylcyclohexyl)-2-methylpropane, and
2,4-dicyclohexyl-2-methylpentane.

The traction drive fluid composition of the present invention contains the hydrogenated product of a cyclic monoterpenoid polymer as an essential component and further, in some cases, a liquid material (traction drive fluid). The traction drive fluid composition of the present invention may further contain suitable amounts of additives such as an antioxidant, a rust inhibitor, a detergent dispersant, a pour point depressant, a viscosity index improver, a extreme pressure agent, an antiwear agent, a fatigue-preventing agent, an antifoam agent, an oiliness improver, a colorant and the like.

According to the present invention, a high traction coefficient can be attained over a wide temperature range of from ordinary temperature to high temperature and a transmission efficiency is increased. As a result, miniaturization and reduction in weight of the traction drive unit, lengthening the service life of the traction drive unit, and increasing the power of the traction drive unit can be realized. Thus the traction drive fluid composition of the present invention can be used in a variety of machines such as continuously variable transmissions for cars or industrial machines, and hydraulic machines The hydrogenated product of cyclic monoterpenoid polymer having a degree of polymerization of 2 or more, particularly a degree of polymerization of 3 or more can increase the traction coefficient of the other fluid only by adding in a small amount, and thus can provide an excellent traction drive fluid The present invention is described in greater detail with reference to the following examples The traction coefficient was measured by the use of a twin disk machine The two rollers were in contact with each other and were of the same size The diameter was 52 mm and the thickness was 6 mm, and the roller to be driven was of the barrel shape having a curvature radius of 10 mm and the driving roller was of the flat shape having no crowning. One was rotated at a constant speed (1,500 rpm) and the other was continuously rotated at a varied speed from 1,500 to 1,750 rpm. A load of 7 kg was applied on the contact portion of the two rollers by means of a spring, and the tangential force, i.e., traction force generated between the rollers was measured and the traction coefficient was determined. The rollers were subjected to bearing steel SUJ-2 mirror finishing and the maximum Herzian contact pressure was 112 kgf/mm$^2$.

EXAMPLE 1

Three hundred ml of methylcyclohexane as a solvent and 10 g of activated clay (trade name: Galleon Earth NS produced by Mizusawa Kagaku Co., Ltd.) as catalyst were placed in a 2 liter four-necked flask equipped with a stirrer, a thermometer, a dropping funnel and a Dimroth reflux condenser. The mixture was heated to 85° C. on an oil bath while stirring and then 1,000 g of dipentene (dl-limonene) was dropped thereto with stirring over one hour. Thereafter, the reaction was conducted at 85° C. for 8 hours while stirring. At the end of the time, the reaction mixture was cooled, and the catalyst was filtered off with a filter paper and the solvent and unreacted starting material were recovered by the use of a rotary evaporator to obtain 650 g of the residual reaction mixture.

Six hundred and fifty grams of the residual reaction mixture and 10 g of a nickel catalyst for hydrogenation (trade name: N-113 produced by Nikki Kagaku Co., Ltd.) were placed in a 1-liter autoclave, and hydrogenation was conducted for 3 hours at a temperature of 150° C. under a hydrogen pressure of 50 kg/cm$^2$G. After the reaction mixture was cooled, the catalyst was filtered off, and an analysis showed that the degree of hydrogenation was 99% or more.

The hydrogenated product was vacuum distilled to obtain 400 g of a fraction having a boiling point range of 110 to 122° C./0.2 mmHg. The fraction was analyzed using a gas chromatography-mass spectrometer (GC-MS) This analysis showed that the fraction was a mixture of compounds all having 20 carbon atoms (hydrogenated dimers of dipentene (dl-limonene)).

Properties of the product were as follows:

| | |
|---|---|
| Kinematic viscosity | 33.05 cSt (40° C.)<br>3.825 cSt (100° C.) |
| Viscosity index | −185 |
| Specific gravity (15/4° C.) | 0.9109 |
| Pour point | −22.5° C. |
| Refractive index ($n_D^{20}$) | 1.4931 |

The traction coefficient of the product was measured over a temperature range from 60° C. to 140° C. The results are shown in FIG. 1.

EXAMPLE 2

Three hundred milliliters of cyclohexane as a solvent and 10 grams of activated clay (trade name: Galleon Earth NS, produced by Mizusawa Kagaku Co., Ltd.) as a catalyst were placed in a 2-liter four-necked flask equipped with similar apparatus to those in Example 1 mentioned above. Then 1000 grams of $\beta$-pinene was gradually added dropwise with stirring over four hours at a room temperature. The reaction was conducted further 30 minutes while stirring. At the end of the time, the catalyst was filtered off with a filter paper, and the solvent and the unreacted starting material were recovered by the use of a rotary evaporator to obtain 800 grams of the residual reaction mixture.

Seven hundred grams of the residual reaction mixture and 10 grams of a nickel catalyst for hydrogenation (trade name: N-113, produced by Nikki Kagaku Co., Ltd.) were placed in a 1-liter autoclave, and hydrogenated for 3 hours at a reaction temperature of 100° C. under a hydrogen pressure of 50 kg/cm$^2$G. After the reaction mixture was cooled, the catalyst was filtered off and analyzed. The analysis showed that the degree of hydrogenation was 99% or more.

The hydrogenated product was vacuum distilled to obtain 200 grams of a fraction having a boiling point range from 108 to 120° C./0.2 mmHg. The fraction was analyzed using a gas chromatography-mass spectrometer (GC-MS). This analysis showed that the fraction was a mixture of compounds all having 20 carbon atoms (hydrogenated dimers of β-pinene).

Properties of the product were as follows.

| | |
|---|---|
| Kinematic viscosity | 32.53 cSt (40° C.)<br>3.978 cSt (100° C.) |
| Viscosity index | −133 |
| Specific gravity (15/4° C.) | 0.9273 |
| Pour point | −27.5° C. |
| Refractive index ($n_D^{20}$) | 1.4974 |

Figure 2:
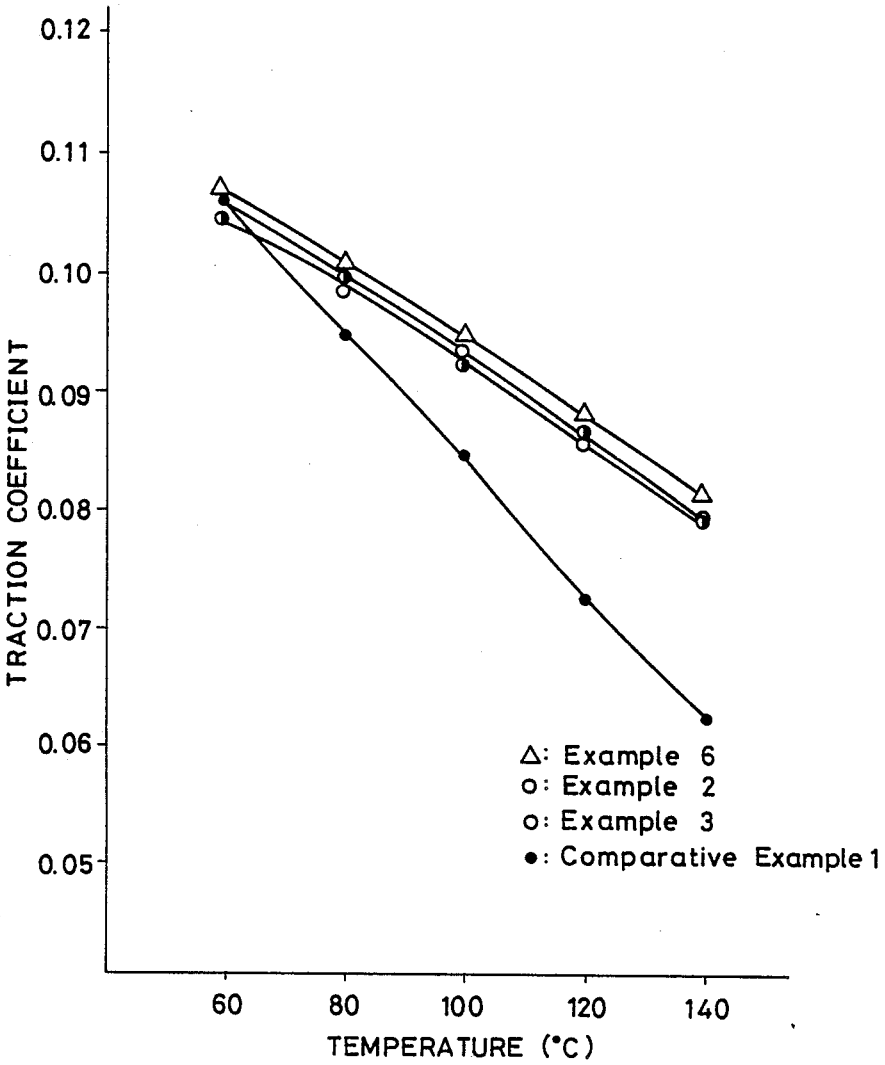

The traction coefficient of the product was measured over a temperature range from 60° C. to 140° C. The results are shown in FIG. 2.

EXAMPLE 3

Three hundred milliliters of methylcyclohexane as a solvent and 10 grams of activated clay (trade name: Galleon Earth NS, produced by Mizusawa Kagaku Co., Ltd.) as a catalyst were placed in a 2-liter four-necked flask equipped with similar apparatus to those in Example 1 mentioned before. The mixture was heated to 80° C. on an oil bath while stirring and then 1000 grams of turpentine oil (93% of pinene, 3% of β-pinene and 4% of other components) was dropped with stirring over 4 hours. Thereafter, the reaction was conducted at 80° C. for 4 hours while stirring. At the end of the time, the reaction mixture was cooled, and the catalyst was filtered off with a filter paper and the solvent and the unreacted starting material were recovered by the use of a rotary evaporator to obtain 700 grams of residual reaction mixture.

Seven hundred grams of the residual reaction mixture and 10 grams of a nickel catalyst for hydrogenation (trade name: N-113, produced by Nikki Kagaku Co., Ltd.) were placed in a 1-liter autoclave, and hydrogenated for 3 hours at a reaction temperature of 100° C. under a hydrogen pressure of 50 kg/cm$^2$G. After the reaction mixture was cooled, the catalyst was filtered off, and an analysis showed that the degree of hydrogenation was 99% or more.

The hydrogenated product was vaccum distilled to obtain 200 grams of fraction having a boiling point range from 108 to 120° C./0.2 mmHg. The fraction was analyzed using a gas chromatography-mass spectrometer (GC-MS). This analysis showed that the fraction was a mixture of compounds all having 20 carbon atoms (hydrogenated dimers of turpentine oil).

Properties of the product were as follows.

| | |
|---|---|
| Kinematic viscosity | 33.21 cSt (40° C.) |

-continued

| | |
|---|---|
| | 3.996 cSt (100° C.) |
| Viscosity index | −133 |
| Specific gravity (15/4° C.) | 0.9276 |
| Pour point | −27.5° C. |
| Refractive index ($n_D^{20}$) | 1.4977 |

The fraction coefficient of the product was measured over a temperature range from 60° C. to 140° C. The results are shown in FIG. 2.

EXAMPLE 4

Three hundred milliliters of methylcyclohexane as a solvent, 150 grams of activated clay (trade name: Galleon Earth NS, produced by Mizusawa Kagaku Co., Ltd.) as a catalyst and 593.10 grams of camphene as a starting material were placed in a 2-liter four-necked flask equipped with similar apparatus to those in Example 1 mentioned before. The mixture was heated to 120° C. on an oil bath while stirring and the reaction was conducted for 10 hours. At the end of the time, the reaction mixture was cooled to a room temperature, and the catalyst was filtered off with a filter paper, and the solvent and the unreacted starting material were recovered by the use of a rotary evaporator to obtain 345.50 grams of residual reaction mixture. The residual reaction mixture was vacuum distilled to obtain 221.10 grams of fraction having a boiling point range from 126 to 134° C./0.2 mmHg. An analysis showed that the fraction was the dimer of camphene (purity: 98%).

Thereafter, 220 grams of the fraction and 10 grams of a nickel catalyst for hydrogenation (trade name: N-113, produced by Nikki Kagaku Co., Ltd.) were placed in a 1-liter autoclave, and hydrogenated for 4 hours at a reaction temperature of 140° C. under a hydrogen pressure of 60 kg/cm$^2$G. After the hydrogenated product was cooled, the catalyst was filtered off, and an analysis showed that the degree of hydrogenation was 99% or more.

Properties of the hydrogenated product were as follows.

| | |
|---|---|
| Kinematic viscosity | 55.52 cSt (40° C.)<br>5.793 cSt (100° C.) |
| Viscosity index | −7 |
| Specific gravity (15/4° C.) | 0.9453 |
| Refractive index ($n_D^{20}$) | 1.5004 |

Figure 3:
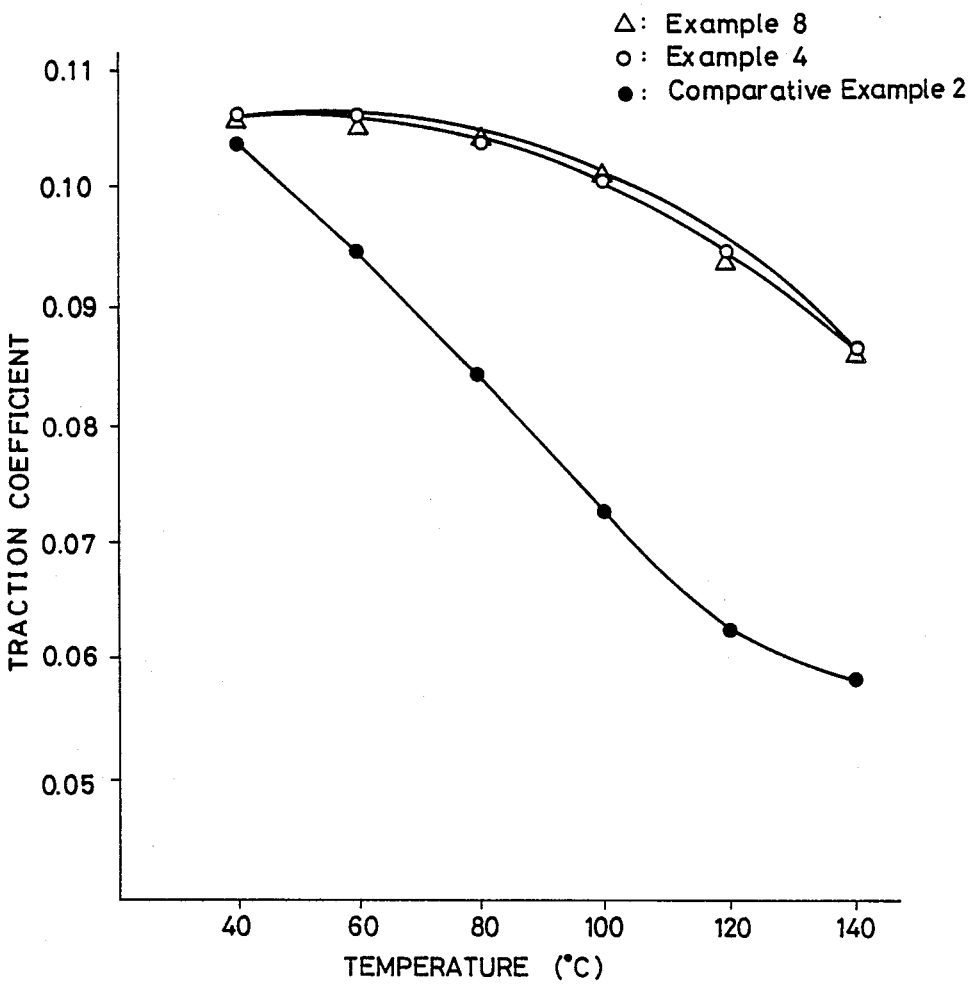

The fraction coefficient of the product was measured over a temperature range from 40° to 140° C. The results are shown in FIG. 3.

EXAMPLE 5

Three hundred milliliters of methylcyclohexane as a solvent and 50 grams of activated clay (trade name: Galleon Earth NS, produced by Mizusawa Kagaku Co., Ltd.) as a catalyst were placed in a 2-liter four-necked flask equipped with similar apparatus to those in Example 1 mentioned before. The mixture was heated to 90° C. on an oil bath while stirring and the mixture of 500 grams of gum turpentine oil (92% of α-pinene, 5% of β-pinene and 3% of other components) and 500 grams of dipentene (dl-limonene) was dropped with stirring over 2 hours. Thereafter, the reaction was conducted at 110° C. for 7 hours while stirring. At the end of the time, the reaction mixture was cooled, and the catalyst was filtered off with a filter paper and the solvent and the unreacted starting material were recovered by the use of a rotary evaporator to obtain 600 grams of residual reaction mixture.

Six hundred grams of the residual reaction mixture and 10 grams of a nickel catalyst for hydrogenation (trade name: N-113, produced by Nikki Kagaku Co., Ltd.) were placed in a 1-liter autoclave, and hydrogenated for 3 hours at a reaction temperature of 150° C. under a hydrogen pressure of 50 kg/cm$^2$G. After the reaction mixture was cooled, the catalyst was filtered off, and an analysis showed that the degree of hydrogenation was 99% or more.

The hydrogenated product was vacuum distilled to obtain 380 grams of fraction having a boiling point range from 105 to 125° C./0.15 mmHg.

Properties of the product were as follows.

| | |
|---|---|
| Kinematic viscosity | 35.61 cSt (40° C.)<br>4.089 cSt (100° C.) |
| Viscosity index | −152 |
| Specific gravity (15/4° C.) | 0.9241 |
| Refractive index ($n_D^{20}$) | 1.4959 |

Figure 4:
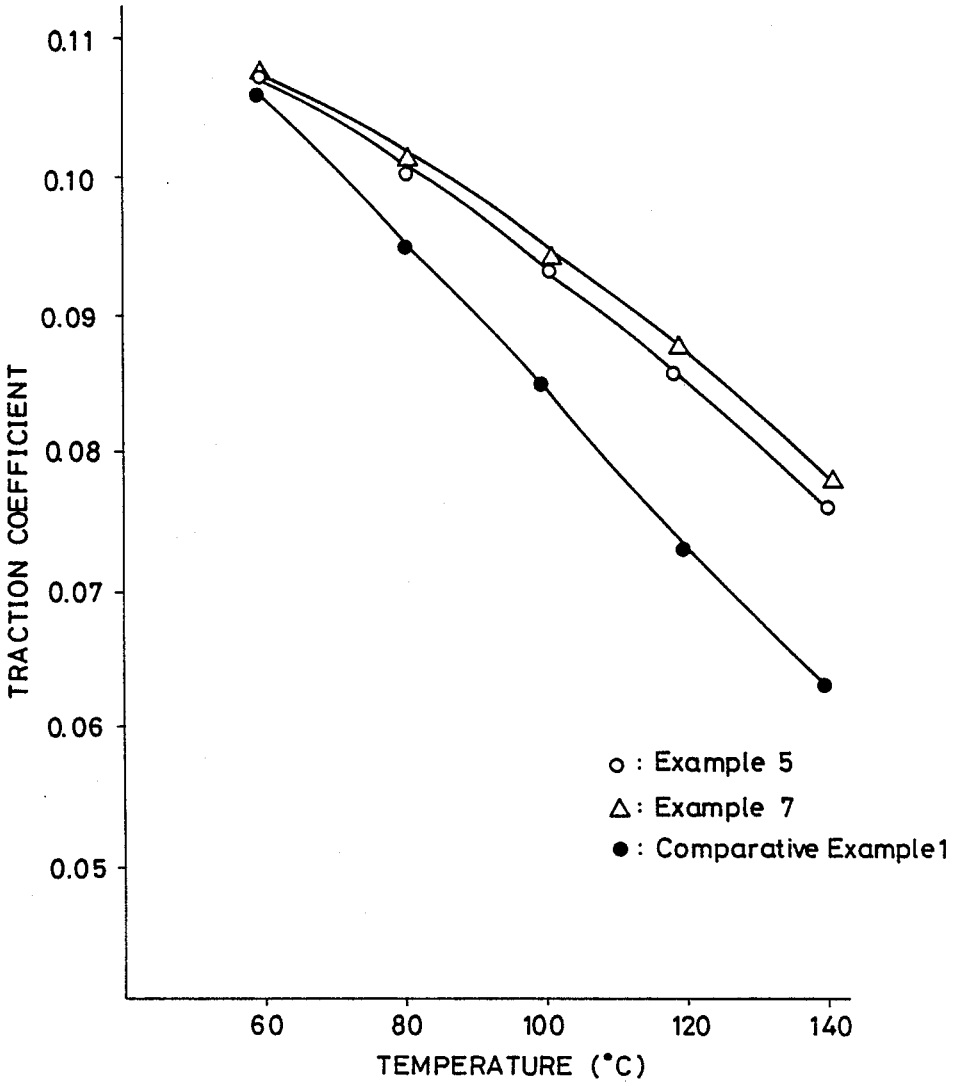

The traction coefficient of the product was measured over a temperature range from 60° C. to 140° C. The results are shown in FIG. 4.

EXAMPLE 6

Three hundred milliliters of methylcyclohexane as a solvent and 130 grams of activated clay (having been dried for 8 hours at 120° C.) (trade name: Galleon Earth NS, produced by Mizusawa Kagaku Co., Ltd.) as a catalyst were placed in a 2-liter four-necked flask equipped with similar apparatus to those in Example 1 mentioned before. Five hundred grams of gum turpentine oil (92% of -pinene, 5% of -pinene and 3% of other components) were dropped with stirring over 2 hours at a room temperature. At the end of dropping, the temperature was 75° C. Thereafter, the reaction was conducted for 2 hours while stirring, and the temperature returned to a room temperature. Subsequently, the catalyst was filtered off with a filter paper and the solvent and the unreacted starting material were recovered by the use of a rotary evaporator to obtain 425 grams of residual reaction mixture.

Four hundred and twenty grams of the residual reaction mixture and 20 grams of ruthenium-carbon catalyst for hydrogenation (produced by Japan Engelhard Co., Ltd.) were placed in a 1-liter autoclave, and hydrogenated for 6 hours at a reaction temperature of 50° C. under a hydrogen pressure of 50 kg/cm$^2$G. After the reaction mixture was cooled, the catalyst was filtered off, and an analysis showed that the degree of hydrogenation was 99% or more.

The hydrogenated product was vacuum distilled to obtain 150 grams of fraction having a boiling point range from 132 to 144° C./0.4 mmHg. The fraction was analyzed using a gas chromatography-mass spectrometer (GC-MS). This analysis showed that the fraction was a mixture of compounds all having 20 carbon atoms (hydrogenated dimers of turpentine oil).

Properties of the product were as follows.

| | |
|---|---|
| Kinematic viscosity | 36.53 cSt (40° C.)<br>4.201 cSt (100° C.) |
| Viscosity index | −133 |
| Specific gravity (15/4° C.) | 0.9390 |
| Pour point | −25.0° C. |
| Refractive index ($n_D^{20}$) | 1.5039 |

The traction coefficient of the product was measured over a temperature range from 60° C. to 140° C. The results are shown in FIG. 2.

EXAMPLE 7

Two hundred milliliters of ethylcyclohexane as a solvent and 50 grams of activated clay (having been dried for 8 hours at 120° C.) (trade name: Galleon Earth NS, produced by Mizusawa Kagaku Co., Ltd.) as a catalyst were placed in a 2-liter four-necked flask equipped with similar apparatus to those in Example 1 mentioned above. A mixture of 263.87 grams of gum turpentine oil (92% of $\alpha$-pinene, 5% of $\beta$-pinene and 3% of other components) and 283.71 grams of camphene was dropped with stirring over 3 hours at a room temperature. Thereafter, the reaction was conducted for 3 hours while stirring at 115° C. At the end of the time, the reaction mixture was cooled, and the catalyst was filtered off with a filter paper, and the solvent and the unreacted starting material were recovered by the use of a rotary evaporator to obtain 410 grams of residual reaction mixture.

Four hundred grams of the residual reaction mixture and 20 grams of ruthenium-carbon catalyst for hydrogenation (produced by Japan Engelhard Co., Ltd.) were placed in a 1-liter autoclave, and hydrogenated for 6 hours at a reaction temperature of 50° C. under a hydrogen pressure of 50 kg/cm$^2$G. After the reaction mixture was cooled, the catalyst was filtered off, and an analysis showed that the degree of hydrogenation was 99% or more.

The hydrogenated product was vacuum distilled to obtain 120 grams of fraction having a boiling point range from 135 to 141° C./0.4 mmHg.

Properties of the product were as follows.

| | |
|---|---|
| Kinematic viscosity | 40.01 cSt (40° C.)<br>4.641 cSt (100° C.) |
| Viscosity index | −65 |
| Specific gravity (15/4° C.) | 0.9434 |
| Pour point | −27.5° C. |
| Refractive index ($n_D^{20}$) | 1.5042 |

The traction coefficient of the product was measured over a temperature range from 60° C. to 140° C. The results are shown in FIG. 4.

EXAMPLE 8

Three hundred milliliters of cyclohexane as a solvent and 150 grams of activated clay (having been dried for 8 hours at 120° C.) (trade name: Galleon Earth NS, produced by Mizusawa Kagaku Co , Ltd.) as a catalyst and 526.10 grams of isoborneol as a starting material were placed in a 2-liter four-necked flask equipped in the same way as in Example 1 except that a dehydrator of Dean-Stark type was installed under the dimroth reflux condenser. The mixture was heated on an oil bath with stirring and the reaction was conducted at 133° C. for 10 hours while removing the resulting water. After the reaction mixture was cooled to a room temperature, the catalyst was filtered off with a filter paper, and recovered by the use of a rotary evaporator to obtain 326.30 grams of residual reaction mixture. The residual reaction mixture was vacuum distilled to obtain 200.50 grams of a fraction having a boiling point range from 125 to 138° C./0.2 mmHg. An analysis showed that the fraction was the dimers of camphene resulted from dehydrated isoborneol (purity: 98%).

Thereafter, 180 grams of the fraction and 10 grams of nickel catalyst for hydrogenation (trade name: N-113, produced by Nikki Kagaku Co., Ltd.) were placed in a 1 -liter autoclave, and hydrogenated for 4 hours at a reaction temperature of 140° C. under a hydrogen pressure of 60 kg/cm$^2$G. After the reaction mixture was cooled, the catalyst was filtered off, and an analysis showed that the degree of hydrogenation was 99% or more.

Properties of the hydrogenated product were as follows.

| | |
|---|---|
| Kinematic viscosity | 56.53 cSt (40° C.)<br>5.801 cSt (100° C.) |
| Viscosity index | −12 |
| Specific gravity (15/4° C.) | 0.9459 |
| Refractive index ($n_D^{20}$) | 1.5010 |

The traction coefficient of the product was measured over a temperature range from 40° C. to 140° C. The results are shown in FIG. 3.

COMPARATIVE EXAMPLE 1

A thousand grams of α-methylstyrene, 50 grams of acid clay and 50 grams of ethylene glycol were placed in a 2-liter four-necked flask equipped in the same way as in Example 1 and reacted at 140° C. for 2 hours while stirring The reaction mixture was filtered to remove the catalyst and distilled to separate the unreacted α-methylstyrene and ethylene glycol, to obtain 900 grams of a fraction having a boiling point range of 125 to 130° C./0.2 mmHg. Nuclear magnetic resonance (NMR) analysis and gas chromatographic analysis confirmed that the fraction was a mixture of 95% of a linear dimer of α-methylstyrene and 5% of a cyclic dimer of α-methylstyrene.

Five hundred milliliters of the fraction was hydrogenated in the same manner as in Example 1 except for the reaction temperature of 200° C., to obtain a traction drive fluid composed mainly of 2,4-dicyclohexyl-2 -methylpentane.

Properties of the product were as follows.

| | |
|---|---|
| Kinematic viscosity | 20.27 cSt (40° C.)<br>3.580 cSt (100° C.) |
| Viscosity index | 13 |
| Pour point | −35° C. or lower |

The traction coefficient of the product was measured over a temperature range from 60° C. to 140° C. The results are shown in FIGS. 1, 2 and 4.

COMPARATIVE EXAMPLE 2

Five hundred milliliters of methylcyclohexane as a solvent and 156.02 grams of isoborneol as a starting material and 184.01 grams of triethylamine were placed in a 2-liter four-necked flask equipped in the same way as in the Example 1. Then a solution of 146.84 grams of cyclohexanecarbonyl chloride dissolved in 100 milliliters of methylcyclohexane was dropped thereto at a room temperature over 4 hours while stirring. Thereafter, the reaction was conducted at 60° C. for 2 hours to completion.

At the end of the time, the reaction mixture was cooled, the decomposed triethylammonium chloride was filtered off, and then the solvent and unreacted starting material were recovered by the use of a rotary evaporator to obtain 252.51 grams of residual reaction mixture. The residual reaction mixture was vacuum distilled to obtain 196.48 grams of a fraction having a boiling point range from 121 to 131° C./0.2 mmHg. The fraction was analyzed by nuclear magnetic resonance (NMR) spectrum, infrared ray (IR) absorption spectrum, a gas chromatographymass spectrometer (GC-MS) and a gas chromatography (GC) of flame ionization detecting (FID) type. This analysis showed that 99% of the fraction was isobornylcyclohexane carboxylate.

Properties of the product were as follows

| | |
|---|---|
| Kinematic viscosity | 24.04 cSt (40° C.)<br>3.966 cSt (100° C.) |
| Viscosity index | 16 |
| Specific gravity (15/4° C.) | 1.0062 |
| Refractive index ($n_D^{20}$) | 1.4860 |

The traction coefficient of the product was measured over a temperature range from 40° C. to 140° C. The results are shown in FIG. 3.

EXAMPLE 9

The fluid obtained in the Comparative Example 1 was mixed with 15% by weight of a hydrogenated terpene resin on the market (number average molecular weight: 630, trade name: Clearon P-85, produced by Yasuhara Yushi Kogyo Co., Ltd.) which is hydrogenated polymer of trimer or higher one composed of pinene or limonene as the starting material, to obtain a fluid having the following properties.

| | |
|---|---|
| Kinematic viscosity | 47.96 cSt (40° C.)<br>5.554 cSt (100° C.) |
| Viscosity index | 13 |
| Specific gravity (15/4° C.) | 0.9153 |
| Refractive index ($n_D^{20}$) | 1.4973 |

Figure 5:
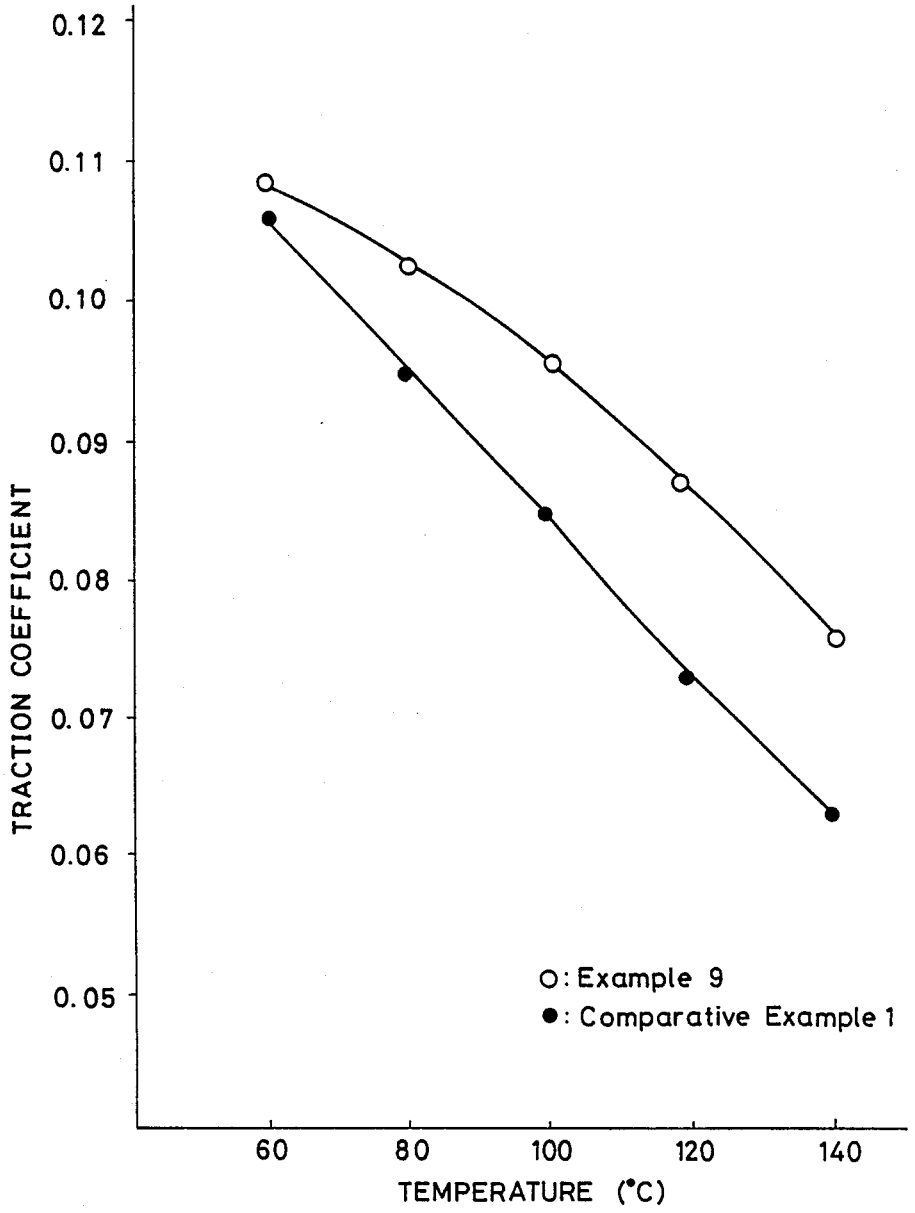

The traction coefficient of the product was measured over a temperature range from 60° C. to 140° C. The results are shown in FIG. 5.

COMPARATIVE EXAMPLE 3

Five hundred and fifty-two grams of toluene, 27.6 grams of anhydrous aluminum chloride and 12.6 grams of nitromethane were placed in a 2-liter four-necked flask. Then 181.2 grams of methallyl chloride was dropped thereto at 0° C. over 2 hours while stirring, and the resulting mixture was stirred for further 1 hour to complete the reaction. At the end of the time, 75 milliliters of water was added to the flask to decompose the aluminum chloride. Thereafter the oil layer was separated and washed once with water and twice with 300 milliliters of 1 normal aqueous solution of sodium hydroxide, and then dried over anhydrous magnesium sulfate.

The resulting material was distilled to remove the unreacted starting material by the use of a rotary evaporator, and vacuum distilled to obtain 254 grams of a fraction having a boiling point range from 114 to 116° C./0.14 mmHg.

An analysis showed that the fraction was composed of a mixture of 80% of 2-methyl-1,2-ditolylpropane and 20% of 2-methyl-1, 1-ditolylpropane.

Subsequently, 250 grams of the fraction was placed in a 1-liter autoclave and 20 g of a nickel catalyst (trade name: N-113, produced by Nikki Kagaku Co., Ltd.) was added thereto, and hydrogenated at a temperature of 180° C. under a hydrogen pressure of 70 kg/cm$^2$G over 5 hours. The reaction product was separated from the catalyst and analyzed. This analysis confirmed that the degree of hydrogenation was 99.9% or more, and that the product was composed of 80% of 2-methyl-1,2-di(-methylcyclohexyl) propane and 20% of 2-methyl-1,1-di(methylcyclohexyl) propane.

Properties of the product were as follows.

| | |
|---|---|
| Kinematic viscosity | 13.17 cSt (40° C.)<br>2.622 cSt (100° C.) |
| Viscosity index | −30 |
| Specific gravity (15/4° C.) | 0.8824 |
| Refractive index ($n_D^{20}$) | 1.4800 |
| Pour point | −35° C. or lower |

Figure 6:
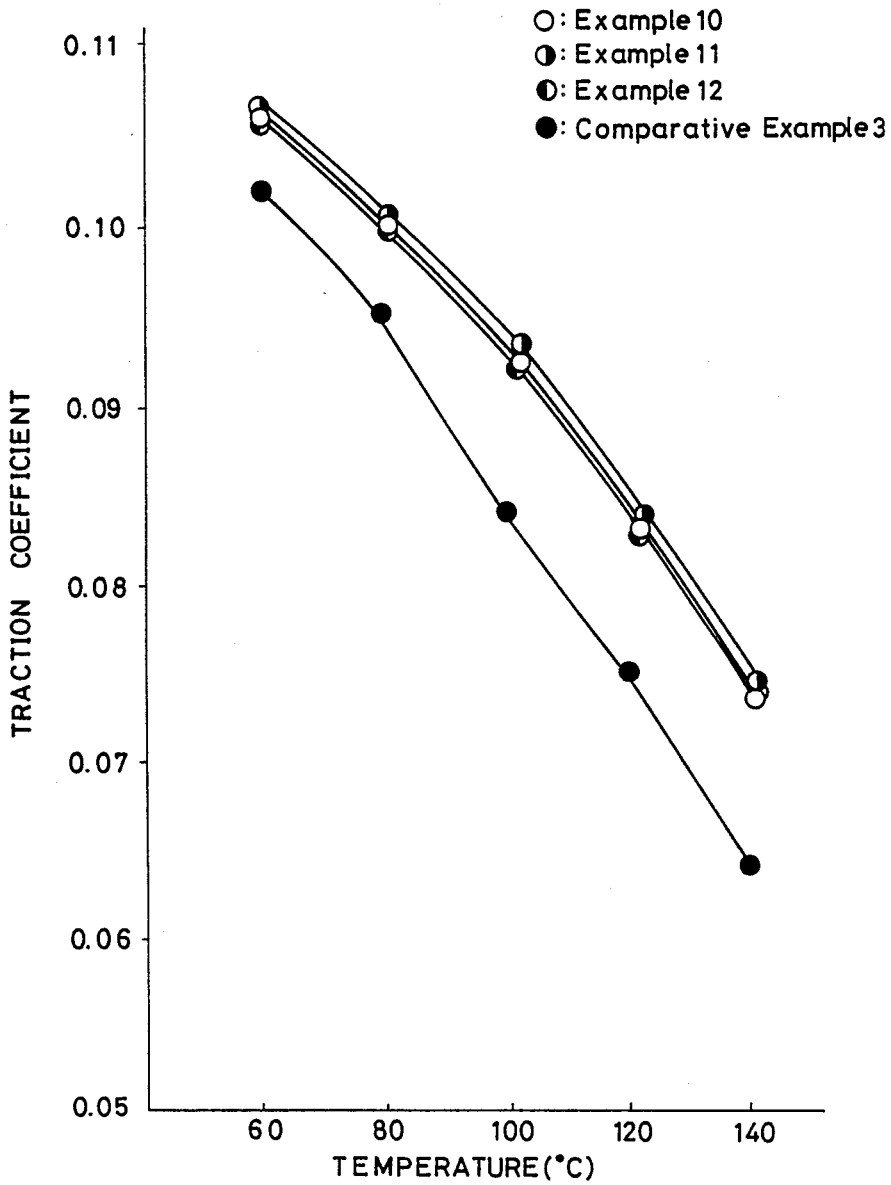

The traction coefficient of the product was measured over a temperature range from 60° C. to 140° C. The results are shown in FIG. 6.

EXAMPLE 10

Three hundred milliliters of methylcyclohexane as a solvent and 10 grams of activated clay (trade name: Galleon Earth NS, produced by Mizusawa Kagaku Co , Ltd.) as a catalyst were placed in a 2-liter four-necked flask equipped with a stirrer, a thermometer, a dropping funnel and a Dimroth reflux condensor. The mixture was heated to 85° C. on an oil bath while stirring, and 1000 grams of dipentene (dl-limonene) was dropped with stirring over 1 hour. Thereafter, the reaction was conducted at 85° C. for 8 hours while stirring. At the end of the time, the reaction mixture was cooled and filtered with a filter paper to separate the catalyst. The solvent and unreacted starting material were recovered by the use of a rotary evaporator to obtain 650 grams of residual reaction mixture.

Six hundred and fifty grams of the residual reaction mixture and 10 grams of a nickel catalyst for hydrogenation (trade name: N-113, produced by Nikki Kagaku Co., Ltd.) were placed in a 1-liter autoclave, and hydrogenated for 3 hours at a reaction temperature of 150° C. under a hydrogen pressure of 50 kg/cm$^2$G. After the reaction mixture was cooled, the catalyst was filtered off, and an analysis showed that the degree of hydrogenation was 99% or more.

The hydrogenated product was vacuum distilled to remove 400 grams of a fraction having a boiling point range of 110 to 122° C./0.2 mmHg, and to obtain approximately 250 grams of a fraction composed of 90% of trimer, 8% of tetramer and 2% of pentamer and higher polymers of dipentene.

The fraction was mixed into the product of Comparative Example 3 in the amount of 10% by weight, to obtain a fluid having the following properties.

| | |
|---|---|
| Kinematic viscosity | 17.53 cSt (40° C.)<br>3.092 cSt (100° C.) |
| Viscosity index | −35 |

-continued

| | |
|---|---|
| Specific gravity (15/4° C.) | 0.8887 |
| Refractive index ($n_D^{20}$) | 1.4833 |
| Pour point | −35° C. or lower |

The traction coefficient of the product was measured over a temperature range from 60° C. to 140° C. The results are shown in FIG. 6.

EXAMPLE 11

Three hundred milliliters of cyclohexane as a solvent and 10 grams of activated clay (trade name: galleon Earth NS, produced by Mizusawa Kagaku Co., Ltd.) as a catalyst were placed in a 2-liter four-necked flask equipped with a stirrer, a thermometer, a dropping funnel and a Dimroth reflux condensor. Then 1000 grams of β-pinene was dropped with stirring over 4 hours at room temperature. Thereafter, the reaction was conducted for 30 minutes while stirring Subsequently, the reaction mixture was filtered with a filter paper to separate the catalyst, and the solvent and the unreacted starting material were recovered by the use of a rotary evaporator to obtain 800 grams of residual reaction mixture.

Seven hundred grams of the residual reaction mixture and 10 grams of a nickel catalyst for hydrogenation (trade name: N-113, produced by Nikki Kagaku Co., Ltd.) were place in a 1-liter autoclave, and hydrogenated for 3 hours at a reaction temperature of 100° C. under a hydrogen pressure of 50 kg/cm$^2$G. After the reaction mixture was cooled, the catalyst was filtered off, and an analysis showed that the degree of hydrogenation was 99% or more.

The hydrogenated product was vacuum distilled to remove 200 grams of a fraction having a boiling point range of 108 to 120° C./0.2 mmHg, and to obtain approximately 600 grams of a fraction composed of 70% of trimer, 24% of tetramer and 6% of pentamer and higher polymers of β-pinene.

This fraction was mixed with the product obtained in Comparative Example 3 in the amount of 10% by weight, to obtain a fluid having the following properties.

| | |
|---|---|
| Kinematic viscosity | 18.46 cSt (40° C.)<br>3.188 cSt (100° C.) |
| Viscosity index | −35 |
| Specific gravity (15/4° C.) | 0.8898 |
| Refractive index ($n_D^{20}$) | 1.4841 |
| Pour point | −35° C. or lower |

The traction coefficient of the product was measured over a temperature range of from 60° C. to 140° C. The results are shown in FIG. 6.

EXAMPLE 12

Three hundred milliliters of methylcyclohexane as a solvent and 10 grams of activated clay (trade name: Galleon Earth NS, produced Mizusawa kagaku Co., Ltd.) as a catalyst were placed in a 2-liter four-necked flask equipped with a stirrer, a thermometer, a dropping funnel and a Dimroth reflux condensor. The mixture was heated to 90° C. on an oil bath while stirring, and a mixture of 500 grams of gum turpentine oil (92% of α-pinene, 5% of β-pinene and 3% of other components) and 500 grams of dipentene (dl-limonene) was dropped thereto with stirring over 2 hours. Then, the reaction was conducted at 110° C. for 7 hours while stirring. At the end of the time the reaction mixture was cooled and filtered with a filter paper to separate the catalyst. The solvent and unreacted starting material were recovered by the use of a rotary evaporator to obtain 600 grams of residual reaction mixture.

Six hundred grams of the residual reaction mixture and 10 grams of a nickel catalyst for hydrogenation (trade name: N-113, produced by Nikki kagaku Co., Ltd.) were placed in a 1-liter autoclave, and hydrogenated for 3 hours at a reaction temperature of 150° C. under a hydrogen pressure of 50 kg/cm$^2$G. After the reaction mixture was cooled, the catalyst was filtered off, and an analysis showed that the degree of hydrogenation was 99% or more.

The hydrogenated product was vacuum distilled to remove 380 grams of a fraction having a boiling point range of 105 to 125° C./0.15 mmHg, and to obtain 220 grams of a fraction composed of 74% of trimer, 22% of tetramer and 4% of pentamer and higher polymers of pinene-dipentene.

This fraction was mixed with the product obtained in Comparative Example 3 in the amount of 10% by weight, to obtain a fluid having the following properties.

| | |
|---|---|
| Kinematic viscosity | 18.11 cSt (40° C.)<br>3.160 cSt (100° C.) |
| Viscosity index | −33 |
| Specific gravity (15/4° C.) | 0.8890 |
| Refractive index ($n_D^{20}$) | 1.4827 |
| Pour point | −35° C. or lower |

The traction coefficient of the product was measured over a temperature range from 60° C. to 140° C. The results are shown in FIG. 6.

COMPARATIVE EXAMPLE 4

Two thousand, seven hundred grams of ethylbenzene, 58 grams of metallic sodium and 16 grams of potassium hydroxide were placed in a 5-liter glass flask, and heated to 120° C. and a mixture of 1100 grams of α-methylstyrene and 300 grams of ethylbenzene was gradually dropped over 5 hours while stirring at that temperature. Subsequently the reaction was conducted for 1 hour while stirring.

After the completion of the reaction, the resulting oil layer was cooled to separate and recover. Two hundred grams of methylalcohol was added thereto, and then washed three times with 2 liters of 5 normal aqueous solution of hydrochloric acid and 2 liters of a saturated brine, respectively. Subsequently, the oil layer was dried over anhydrous sodium sulfate, and distilled to remove the unreacted ethylbenzene by the use of a rotary evaporator and, then vacuum-distilled to obtain 1350 grams of a fraction having a boiling point range of 106 to 108° C./0.06 mmHg.

Thereafter, 500 milliliters of the fraction was placed in a 1-liter autoclave, and 20 grams of a nickel catalyst for hydrogenation (trade name: N-113, produced by Nikki Kagaku Co., Ltd.) was added thereto. The fraction was hydrogenated at a reaction temperature of 200° C. under a hydrogen pressure of 50 kg/cm$^2$G. After the reaction was completed, the catalyst was removed and light fraction was removed by stripping and the product was analyzed This analysis confirmed that the degree of hydrogenation was 99.9% or more, and that the hydrogenated product was 2,4-dicyclohexylpentane.

Properties of the product were as follows.

| | |
|---|---|
| Kinematic viscosity | 12.05 cSt (40° C.)<br>2.750 cSt (100° C.) |
| Viscosity index | 47 |
| Specific gravity (15/4° C.) | 0.8913 |
| Refractive index ($n_D^{20}$) | 1.4832 |
| Pour point | −35° C. or lower |

Figure 7:
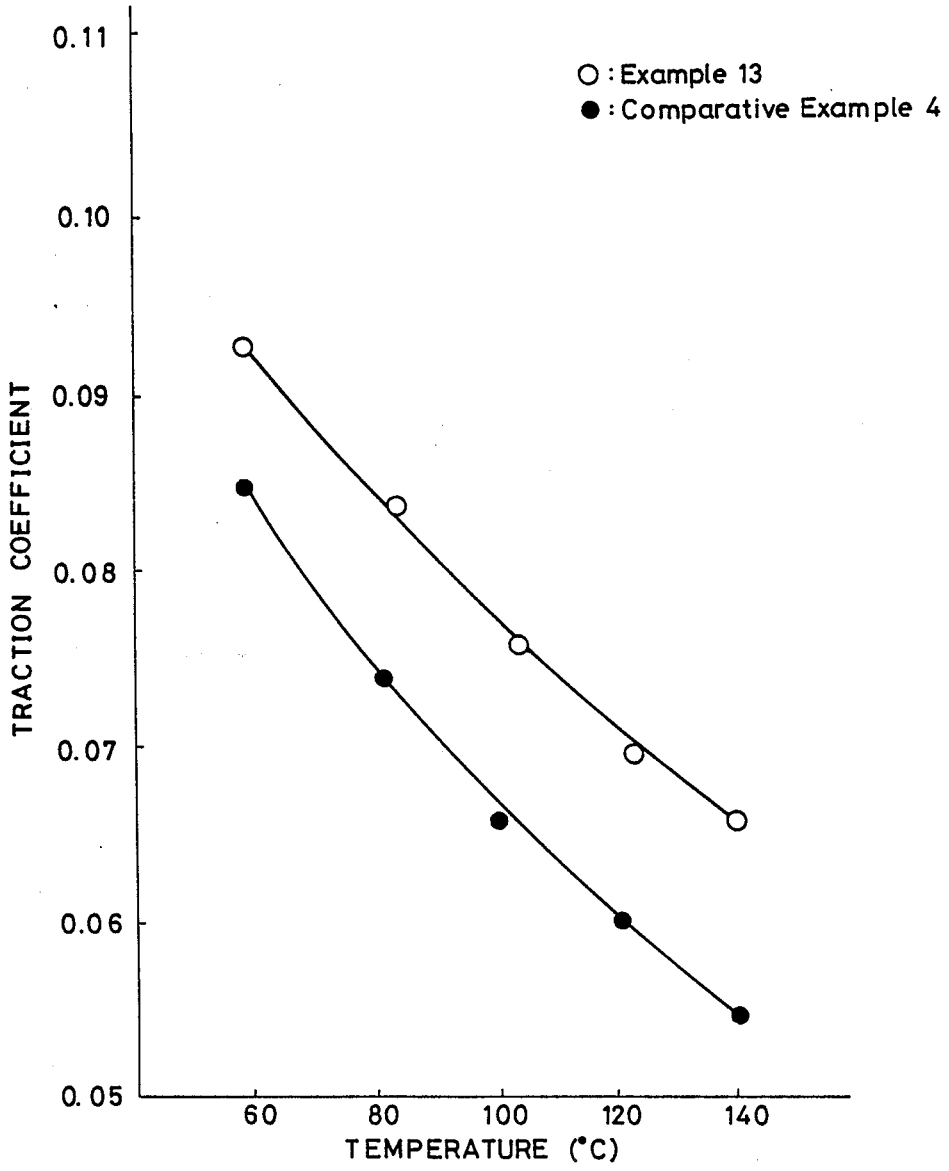

The traction coefficient of the product was measured over a temperature range from 60° C. to 140° C. The results are shown in FIG. 7.

EXAMPLE 13

Three hundred milliliters of methylcyclohexane as a solvent and 20 grams of anhydrous aluminum chloride as a catalyst were placed in 2-liter four-necked flask equipped with a stirrer, a thermometer, a dropping funnel and a Dimroth reflux condensor. Then a mixture of 300 grams of camphene and 50 milliliters of methylcyclohexane was dropped thereto over 1 hour while stirring at room temperature, and heated on an oil bath and the reaction was conducted for 1 hour while stirring at 75° C. After cooled, the reaction solution was poured little by little into 1 liter of ice water to complete the reaction. The organic layer was washed twice with 200 milliliters of 15% hydrochloric acid, three times with 200 milliliters of 10% sodium hydrogencarbonate and twice with 200 milliliters of water, and then dried over anhydrous magnesium sulfate.

After the reaction material was allowed to stand overnight, the anhydrous magnesium sulfate, the drying agent was filtered off, and the solvent and the unreacted starting material were recovered by the use of a rotary evaporator, to obtain 260 grams of the residual reaction solution.

The residual reaction solution was analyzed by a gas chromatography (GC) of flame ionization detecting (FID) type. This analysis showed that the reaction product obtained above was a mixture of 28% of a dimer, 31% of a trimer, 28% of tetramer, and 13% of a pentamer of camphene.

Then 250 grams of the reaction solution and 25 grams of a nickel catalyst for hydrogenation (trade name: N-113, produced by Nikki Kagaku Co., Ltd.) were placed in 1-liter autoclave, and 200 milliliters of methylcyclohexane was added as the solvent and hydrogenated over 5 hours at the reaction temperature of 180° C. under a hydrogen pressure of 90 kg/cm$^2$G. After the reaction mixture was cooled, the catalyst was removed and the product was analyzed. This analysis showed that the degree of hydrogenation was 99% or more. Then the hydrogenated product was vacuum distilled to remove a fraction having a boiling point range from 122 to 136° C./0.2 mmHg, and to obtain 160 grams of a fraction composed of the trimer, the tetramer and the pentamer of camphene.

The fraction was mixed with the product obtained in Comparative Example 4 in the amount of 10% by weight to obtain a fluid having the following properties.

| | |
|---|---|
| Kinematic viscosity | 17.47 cSt (40° C.)<br>3.382 cSt (100° C.) |
| Viscosity index | 36 |
| Specific gravity (15/4° C.) | 0.9005 |
| Refractive index ($n_D^{20}$) | 1.4871 |

-continued

| | |
|---|---|
| Pour point | −35° C. or lower |

The traction coefficient of the product was measured over a temperature range from 60° C. to 140° C. The results are shown in FIG. 7.

As FIGS. 1 to 7 shown clearly, the traction drive fluid of the present invention can maintain a high traction coefficient especially in the range of high temperatures so that it is very favorable as a traction drive fluid.

What is claimed is:

1. A process for improving the coefficient of traction between at least two relatively rotatable elements in a torque transmitting relationship which comprises introducing between the tractive surfaces of said elements a traction drive fluid comprising as the active component at least one hydrogenated cyclic monoterpenoid polymer having a degree of polymerization of 2 to 10;

said cyclic monoterpenoid which is polymerized and hydrogenated is selected from the group consisting of menthadienes, pinenes and bicyclo (2.2.1) heptanes; and when said hydrogenated polymer is a dimer, it comprises at least 5% by weight of said traction drive fluid, and when said hydrogenated polymer has a polymerization degree of 3 to 10, it comprises from 0.1 to 90% by weight of said traction drive fluid.

2. The process as claimed in claim 1 wherein the hydrogenated cyclic monoterpenoid polymer is a hydrogenated product of a dimer of cyclic monoterpenoid.

3. The process as claimed in claim 1 wherein the hydrogenated cyclic monoterpenoid polymer is a hydrogenated product of a trimer of cyclic monoterpenoid.

4. The process as claimed in claim 1 wherein said traction drive contains at least 30% by weight of the hydrogenated cyclic monoterpenoid dimer.

5. The process as claimed in claim 1 wherein said traction fluid drive contains 2 to 60% by weight of the hydrogenated cyclic monoterpenoid polymers having a degree of 3 to 10.

6. A traction drive fluid composition for use between at least two relatively rotatable elements in a torque transmitting relationship which comprises as a traction drive fluid component at least one hydrogenated cyclic monoterpenoid polymer having a degree of polymerization of 2 to 10 admixed with at least one other traction drive fluid component;

said cyclic monoterpenoid which is polymerized and hydrogenated is selected from the group consisting of methadienes, pinenes and bicyclo (2.2.1) heptanes; and when said hydrogenated polymer is a dimer, it comprises at least 5% by weight of said traction drive fluid, and when said hydrogenated polymer has a polymerization degree of 3 to 10, it comprises from 0.1 to 90% by weight of said traction drive fluid.

7. The traction drive fluid composition as claimed in claim 8 which contains at least 30% by weight of the hydrogenated cyclic monoterpenoid dimer.

8. The traction drive fluid composition as claimed in claim 8 which contains 2 to 60% by weight of the hydrogenated cyclic monoterpenoid polymers having a degree of three or more.

9. The traction drive fluid composition as claimed in claim 9 wherein said cyclo monoterpenoid which is polymerized and hydrogenated is selected from the group consisting of limonene (d-, 1- and dl isomers), isolimonene, α-, β-, and γ-terpinene, α-, and β-phellandonene, terpinolene, sylvestrene, α-pinene (d-, 1- and dl-isomers), β-pinene (d- and 1-isomers), δ-pinene (d- and 1-isomers), orthodene, camphene (d-, 1 and dl-isomers), bornylene (d- and 1-isomers), α-fenchene (d-, 1 and dl-isomers), β-fenchene (d- and dl-isomers), γ-fenchene, δ-fenchene, ε-fenchene, ζ-fenchene, borneol (d, 1- and dl-isomers), π-borneol (d- and 1-isomers), ω-borneol, isoborneol (d-, 1- and dl-isomers), camphene hydrate, α-fenchyl alcohol (d-, 1- and dl-isomers), β-fenchyl alcohol (d-, 1- and dl-isomers), α-isofenchyl alcohol (d, 1- and dl-isomers) and β-isofenchyl alcohol (d-, 1- and dl-isomers).

10. The process as claimed in claim 1 wherein said cyclic monoterpenoid which is polymerized and hydrogenated is selected from the group consisting of limonene (d-, 1- and dl isomers), isolimonene, α-, β-, and γ-terpinene, α-, and β-phellandonene, terpinolene, sylvestrene, α-pinene (d-, 1- and dl-isomers), β-pinene (d- and 1-isomers), δ-pinene (d- and 1-isomers), orthodene, camphene (d-, 1 and dl-isomers), bornylene (d- and 1-isomers), α-fenchene (d-, 1- and dl-isomers), β-fenchene (d-and dl-isomers), γ-fenchene, δ-fenchene, ε-fenchene, ζ-fenchene, borneol (d, 1- and dl-isomers), π-borneol (d- and 1-isomers), ω-borneol, isoborneol (d-, 1- and dl-isomers), camphene hydrate, α-fenchyl alcohol (d-, 1- and dl-isomers), β-fenchyl alcohol (d-, 1- and dl-isomers), α-isofenchyl alcohol (d, 1- and dl-isomers) and β-isofenchyl alcohol (d-, 1- and dl-isomers).

11. The process as claimed in claim 5 wherein said cyclic monoterpenoid which is polymerized and hydrogenated is selected from the group consisting of limonene (d-, 1- and dl isomers), isolimonene, α-, β-, and γ-terpinene, α-, and β-phellandonene, terpinolene, sylvestrene, α-pinene (d-, 1- and dl-isomers), β-pinene (d- and 1-isomers), δ-pinene (d- and 1-isomers), orthodene, camphene (d-, 1 and dl-isomers), bornylene (d- and 1-isomers, αfenchene (d-, 1- and dl-isomers), β-fenchene (d-and dl-isomers, γ-fenchene, δ-fenchene, ε-fenchene, ζ-fenchene, borneol (d, 1- and dl-isomers), π-borneol (d- and 1-isomers, ω-borneol, isoborneol (d-, 1- and dl-isomers), camphene hydrate, α-fenchyl alcohol (d-, 1- and dl-isomers), β-fenchyl alcohol (d-, 1- and dl-isomers), αisofenchyl alcohol (d, 1- and dl-isomers) and β-isofenchyl alcohol (d-, 1- and dl-isomers).

12. The process as claimed in claim 7 wherein said cyclic monoterpenoid which is polymerized and hydrogenated is selected from the group consisting of limonene (d-, 1- and dl isomers), isolimonene, α-, β-, and γ-terpinene, α-, and β-phellandonene, terpinolene, sylvestrene, α-pinene (d-, 1- and dl-isomers), β-pinene (d- and 1-isomers), δ-pinene (d- and 1-isomers), orthodene, camphene (d-, 1 and dl-isomers), bornylene (d- and 1-isomers, α-fenchene (d-, 1- and dl-isomers), β-fenchene (d-and dl-isomers), γ-fenchene, δ-fenchene, ε-fenchene, ζ-fenchene, borneol (d, 1- and dl-isomers), π-borneol (d- and 1-isomers, ω-borneol, isoborneol (d-, 1- and dl-isomers), camphene hydrate, α-fenchyl alcohol (d-, 1- and dl-isomers), β-fenchyl alcohol (d-, 1- and dl-isomers), α-isofenchyl alcohol (d, 1- and dl-isomers) and β-isofenchyl alcohol (d-, 1- and dl-isomers).

13. The process as claimed in claim 5 wherein said dimerized and hydrogenated cyclic monoterpenoid is dl-limonene.

14. The process as claimed in claim 5 wherein said dimerized and hydrogenated cyclic monoterpenoid is β-pinene.

15. The process as claimed in claim 5 wherein said dimerized and hydrogenated cyclic monoterpenoid is turpentine oil.

16. The process as claimed in claim 5 wherein said dimerized and hydrogenated cyclic monoterpenoid is camphene.

17. The process as claimed in claim 1 wherein said hydrogenated cyclic monoterpenoid polymer is the hydrogenated product of the copolymerization of pinene and dl-limonene.

18. The process as claimed in claim 1 wherein said hydrogenated cyclic monoterpenoid polymer is the hydrogenated product of the copolymerization of a mixture of pinene, camphene and turpentine oil.

19. The process as claimed in claim 7 wherein said hydrogenated cyclic monoterpenoid polymer is the hydrogenated dimer of at least one selected from the group consisting of pinene or limonene having a number average molecular weight of 630.

20. The process as claimed in claim 7 wherein said hydrogenated cyclid monoterpenoid polymer is a mixture of the trimer and higher polymers of dipentene.

21. The process as claimed in claim 7 wherein said hydrogenated cyclid monoterpenoid polymer is a mixture of the trimer and higher polymers of β-pinene.

22. The process as claimed in claim 7 wherein said hydrogenated cyclid monoterpenoid polymer is a mixture of the trimer and higher polymers of pinene-dipentene.

23. The process as claimed in claim 7 wherein said hydrogenated cyclid monoterpenoid polymer is a mixture of the dimer, trimer, tetramer and pentamer of camphene.

* * * * *